US007325731B2

(12) United States Patent
Tashiro

(10) Patent No.: US 7,325,731 B2
(45) Date of Patent: Feb. 5, 2008

(54) SELF-CHECKOUT TERMINAL

(75) Inventor: Takeshi Tashiro, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/652,995

(22) Filed: Jan. 12, 2007

(65) Prior Publication Data

US 2007/0205277 A1 Sep. 6, 2007

(30) Foreign Application Priority Data

Mar. 2, 2006 (JP) ..... 2006-056265

(51) Int. Cl.
*G06K 15/00* (2006.01)

(52) U.S. Cl. ..... 235/383; 235/385

(58) Field of Classification Search ..... 235/383, 235/385

See application file for complete search history.

(56) References Cited

U.S. PATENT DOCUMENTS 5,083,638 A * 1/1992 Schneider ..... 186/61
5,747,784 A 5/1998 Walter et al.
5,952,642 A * 9/1999 Lutz ..... 235/383
6,354,498 B1 * 3/2002 Lutz ..... 235/385
2003/0028285 A1 * 2/2003 Zura et al. ..... 700/241

FOREIGN PATENT DOCUMENTS

JP 06-028576 A 2/1994
JP 10-208149 A 8/1998
JP 2001-076261 A 3/2001

OTHER PUBLICATIONS

Japanese Office Action dated Nov. 6, 2007 issued in counterpart Japanese Appln. No. 2006-056265 and English translation thereof.

* cited by examiner

*Primary Examiner*—Uyen-Chau N Le
(74) *Attorney, Agent, or Firm*—Frishauf, Holtz, Goodman & Chick, P.C.

(57) ABSTRACT

A self-checkout terminal is provided which includes a sensor for detecting whether or not a customer is in a position where operation of units of the self-checkout terminal by the customer is possible. When the sensor does not detect a customer, a whole guidance screen including a procedure summary of a self-checkout from start to finish is displayed. When the sensor detects a customer, the whole guidance screen is erased and a basic screen is displayed which shows guidance on performing a self-checkout. The guidance displayed on the basic screen is changed in accordance with the stage of the self-checkout.

9 Claims, 15 Drawing Sheets

SELF-CHECKOUT TERMINAL

CROSS-REFERENCE TO RELATED APPLICATION

The present application is based on and claims the benefit of priority of Japanese Patent Application P2006-056265 filed on Mar. 2, 2006, the entire contents of which are incorporated herein by reference.

BACKGROUND OF THE INVENTION

1. Field of the Invention

The present invention relates to a self-checkout terminal for enabling a customer to perform a self-checkout.

2. Description of Related Art

Conventionally, as described in Japanese Patent Laid-Open Publication No. Hei 10(1998)-208149, there has been a self-checkout terminal for enabling a customer to perform a self-checkout. When a customer performs a self-checkout, the customer operates each unit, such as a scanning unit provided to the terminal, by himself or herself. Since a customer trying to perform a self-checkout may be inexperienced in operating the self-checkout terminal, it is important to give some necessary guidance to the customer according to each stage of the self-checkout. A self-checkout terminal described in Japanese Patent Laid-Open Publication No. Hei 10(1998)-208149 includes a video camera as a sensor so as to watch a customer performing a self-checkout. When a scanning error occurs, the self-checkout terminal shows guidance prompting a customer to perform the operation for a second scanning on a display.

Incidentally, it is desirable to inform a customer of a self-checkout flow from start to finish before the customer performs the self-checkout so that the customer performs a self-checkout smoothly.

Japanese Patent Laid-Open Publication No. Hei 06(1994)-028576 discloses that when a sensor provided to a POS terminal detects a customer standing by for a self-checkout, some information is given to the customer through a display. However, details about the information are not obvious. In addition, Japanese Patent Laid-Open Publication No. Hei 10(1998)-208149 does not disclose informing a customer of a self-checkout flow before the self-checkout.

Accordingly, an object of the present invention is to provide a self-checkout terminal that enables informing a customer of a self-checkout flow before the self-checkout without requiring stores to prepare a signboard or video footage showing the self-checkout flow.

SUMMARY OF THE INVENTION

According to the present invention, a self-checkout terminal is provided which includes a settlement terminal which: (i) includes units for self-checkout including a basket placement unit for placing a shopping basket, a scanning unit for scanning merchandise codes, an input unit for inputting information, and a settlement unit for transacting settlement, each of said units being positioned so as to be operable by a customer, and (ii) executes merchandise sales data processing based on at least one of the merchandise codes scanned by the scanning unit and the information input via the input unit. A display is provided to the settlement terminal for displaying information, and a sensor detects whether or not a customer is in a position where operation of the units of the settlement terminal by the customer is possible. The self-checkout terminal includes a controller which (i) when the sensor does not detect a customer, displays on the display a whole guidance screen including a procedure summary of the self-checkout, including use of the units of the settlement terminal, from start to finish of the self-checkout, (ii) when the sensor detects a customer, erases the whole guidance screen on the display and displays on the display a basic screen showing guidance for performing the self-checkout, and (iii) changes the guidance displayed on the basic screen in accordance with a stage of the self-checkout.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

An embodiment of the present invention will be explained with reference to FIGS. 1 to 15.

Figure 1:
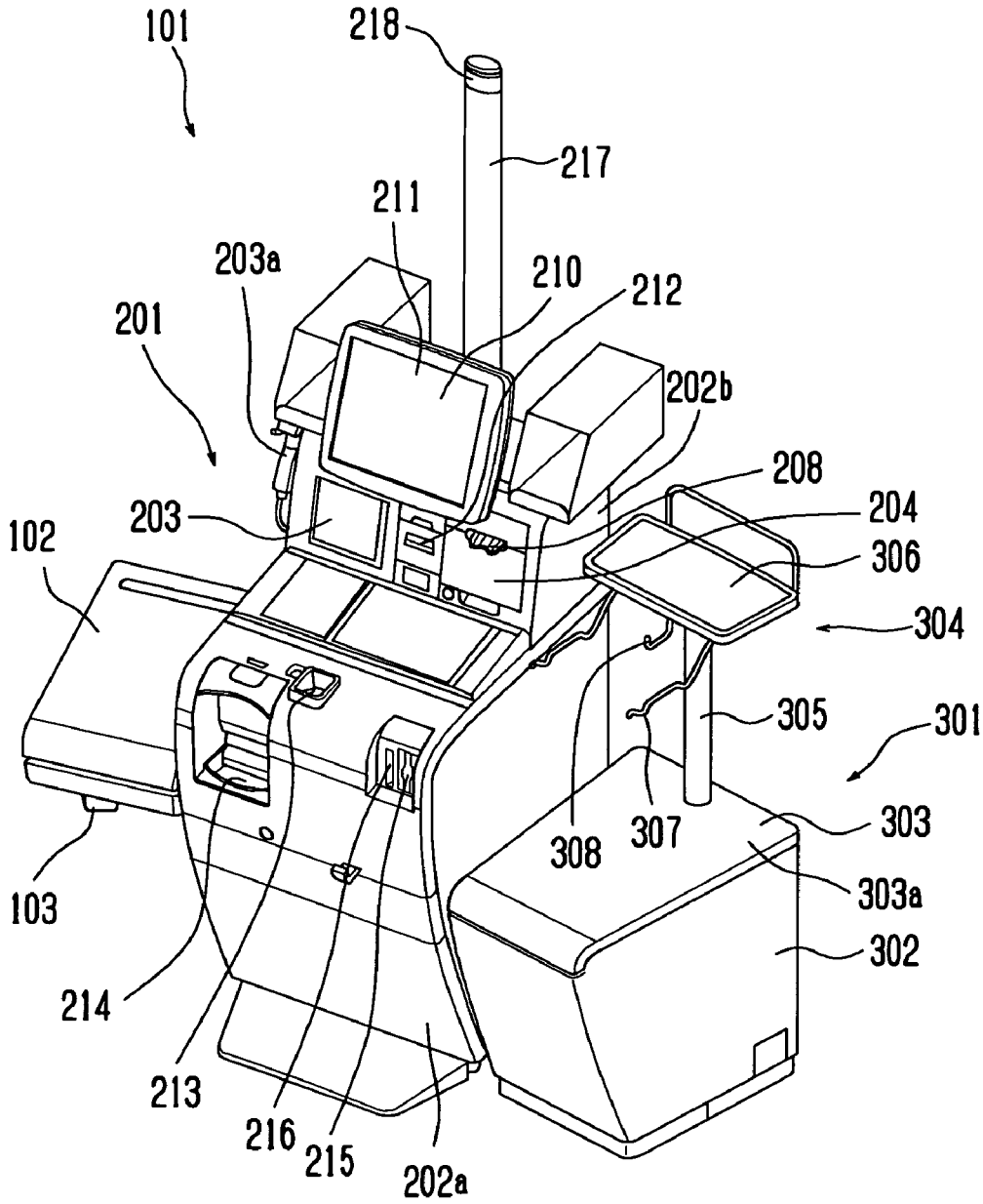
FIG. 1 is a perspective view showing a self-checkout terminal.

FIG. 1 is a perspective view showing a self-checkout terminal 101. The self-checkout terminal 101 includes a settlement terminal 201 and a weighing apparatus 301.

The settlement terminal 201 includes a base housing 202*a* which is placed on a floor of a store and a small upper housing 202*b* which is set on the base housing 202*a*. At a left side of the base housing 202*a*, a basket placement table 102 for a shopping basket (not shown) to be placed is provided as a basket placement unit. At an undersurface of the basket placement table 102, a sensor 103 is provided. The sensor 103 detects whether or not a customer is at a front side of the self-checkout terminal 101. The sensor 103 is a pyroelectric infrared sensor, for example. The pyroelectric infrared sensor detects weak infrared radiation which is emitted by human bodies and which has a wavelength of about 7-20 micrometers.

A barcode scanner 203 as a scanning unit is provided at a front left side of the upper housing 202*b*. A printer cover 204 which includes a receipt outlet 208 is provided at a front right side of the upper housing 202*b*. A receipt printer 251 (see FIG. 3) is provided internally at a back side of the printer cover 204. A receipt (not shown) printed by the receipt printer 251 is issued from the receipt outlet 208. Between the barcode scanner 203 and the printer cover 204, a card insertion slot 212 is disposed. At a back side of the card insertion slot 212, a card reader/writer 252 (see FIG. 3) is provided internally as a settlement unit. The card reader/writer 252 reads information like a card number or a secret number which is stored on a magnetic card like a credit card. A handheld barcode scanner 203*a* is provided as a scanning unit at a left side of the upper housing 202*b*. The handheld barcode scanner 203*a* is used for a customer to scan merchandise codes which are attached to large-size items or heavy items. In the upper housing 202*b*, a speaker 271 (see FIG. 3) to inform a customer of voice information that is spoken aloud is provided internally. To the upper housing 202*b*, a LCD 210 which includes a LCD panel is provided as a display. The LCD 210 includes a touch panel 211 as an input unit on a display surface of the LCD 210.

A cash recycling machine 221 (see FIG. 3) is provided in the base housing 202*a* as a settlement unit. A coin slot 213 as a part of the cash recycling machine 221 is provided at a center of a top of the base housing 202*a*. And, a coin outlet 214 is provided at a left side of the coin slot 213. Both a bill inlet 215 and a bill outlet 216 are provided to a right side of a front of the base housing 202*a*. The cash recycling machine 221 includes a mechanism (not shown) for enabling cash handling and a control unit (not shown) for controlling the cash handling mechanism. Details about a structure of the mechanism and a processing procedure by the control unit are well-known. Therefore, a description of the details will be omitted.

At a backside of the base housing 202*a*, an indicating pole 217 is provided to stand upright. The indicating pole 217 indicates a state of the self-checkout terminal 101. The indicating pole 217 includes a light emitting unit 218 at the top. The light emitting unit 218 selectively emits red light and blue light.

As for the weighing apparatus 301, a weighing plate 303 is provided to the upper part of a weighing apparatus housing 302, and a bag holder 304 is provided to the weighing plate 303. The weighing plate 303 includes a placement table 303*a* on a top surface of the weighing plate 303. The bag holder 304 is provided to the placement table 303*a*. Therefore, the weighing plate 303 is a pedestal for the bag holder 304. That is to say, a pole-shaped supporter 305 is provided to stand upright at a center of aback part of the placement table 303*a*, and a temporary placement table 306 is provided to a top of the supporter 305. A top surface of the temporary placement table 306 is a flat plane. The temporary placement table 306 is a table on which a customer places some items temporarily after their barcodes are scanned. A pair of holding arms 307 and a hook 308 are provided to an undersurface of the temporary placement table 306. The holding arms 307 hold a pair of handles of a plastic shopping bag by extending through the handles. Between the handles of the plastic shopping bag, an ear part is provided. The ear part is separable along a perforation line and has a hole. A plastic shopping bag is held by the holding arms 307 and the hook 308, when the hook 308 is inserted into the hole. The weighing apparatus housing 302 includes a loadcell unit (not shown) internally. The loadcell unit translates loads of items which are placed on the weighing plate 303 into electronic signals. Output signals of the loadcell unit are sent to the settlement terminal 201.

Figure 2:
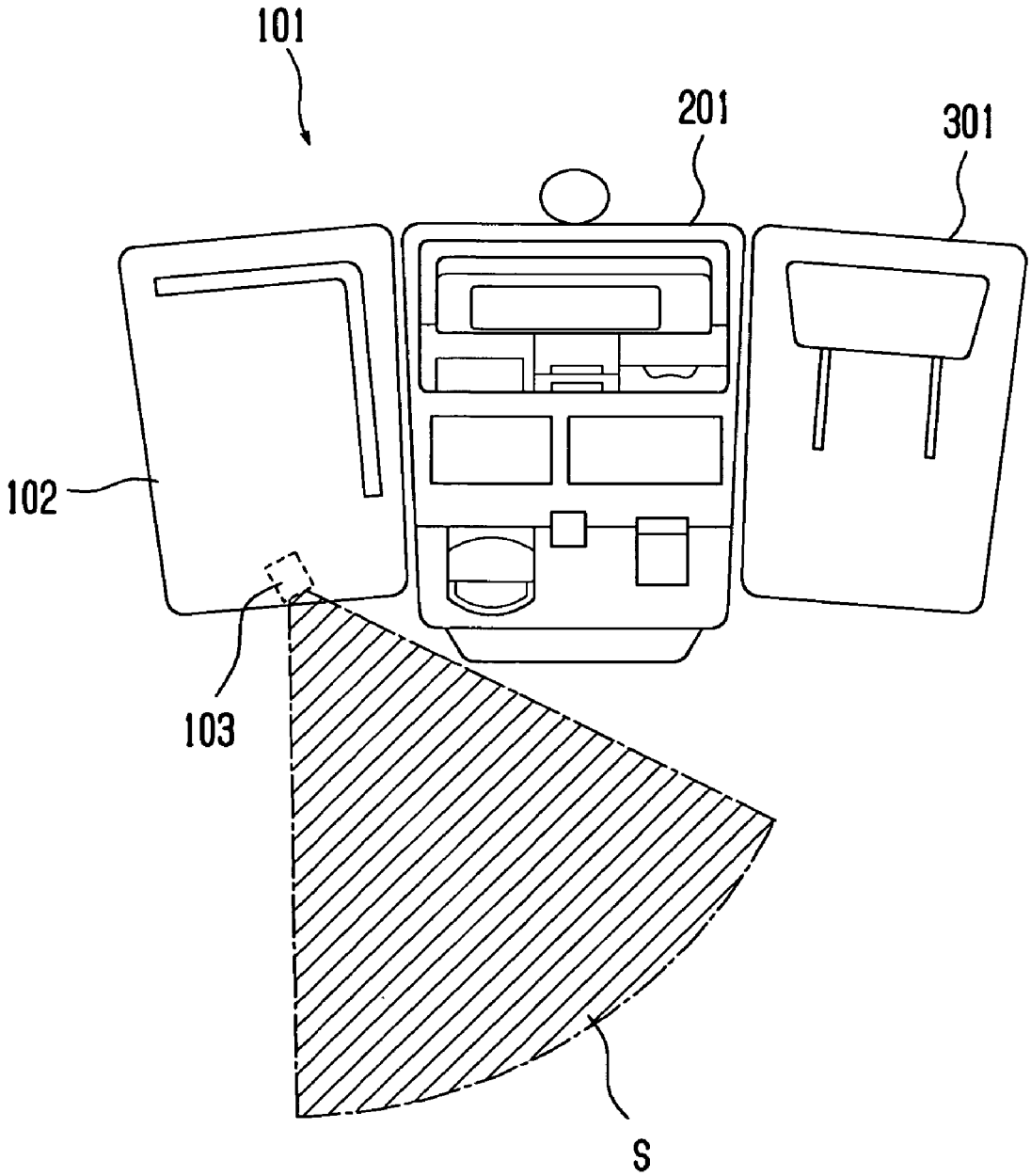
FIG. 2 is a plan view showing a relationship between the self-checkout terminal and a detection area of a sensor.

FIG. 2 is a plan view showing a relationship between the self-checkout terminal 101 and a detection area S of the sensor 103. As shown in FIG. 2, an area just in front of the settlement terminal 201 is designed as an area in which the sensor 103 detects a customer. Due to the detection area S, the sensor 103 can detect that a customer is in a position where the customer can operate each unit of the settlement terminal 201. At first, during self-checkout, a customer seems to approach the settlement terminal 201 from a basket placement table 102 side (left side in FIG. 2) of the settlement terminal 201 to place a shopping basket on the basket placement table 102. Therefore, the sensor 103 which is provided to the basket placement table 102 can detect a customer approaching the settlement terminal 201 from the basket placement table 102 side of the settlement terminal 201. The sensor 103 sends a signal to a controller 253 (see FIG. 3) of the settlement terminal 201 in accordance with whether a customer is in the detection area S or a customer is out of the detection area S.

In the present embodiment, an example in which the sensor 103 is provided to the basket placement table 102 is shown. However, as long as it can be detected that a customer is in a position where the customer can operate each unit of the settlement terminal 201, the invention is not limited to this example. In addition, in the present embodiment, an example in which only the sensor 103 is provided is shown. However, for example, another sensor in addition to the sensor 103 may be provided to the front side of the weighing apparatus 301.

Figure 3:
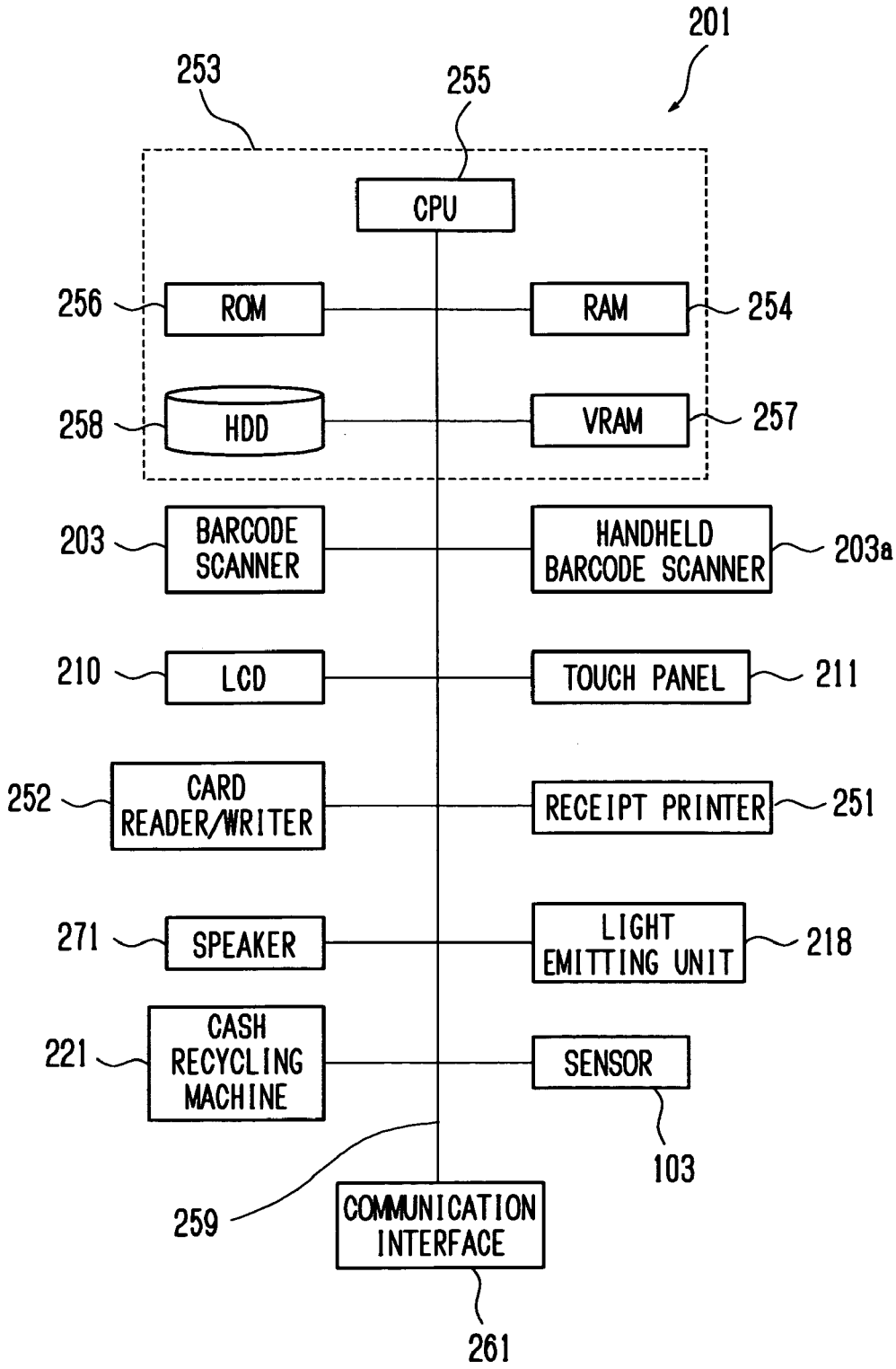
FIG. 3 is a block diagram showing an electrical hardware structure of a settlement terminal.

FIG. 3 is a block diagram showing an electrical hardware structure of the settlement terminal 201. The settlement terminal 201 includes a microcomputer-organized controller 253 internally. A CPU 255 forms a core of the controller 253. A ROM 256 storing fixed data, a RAM 254 storing mutable data so that the mutable data will be freely rewritable, a VRAM 257 generating images displayed on the LCD 210, and a HDD 258 are connected to the CPU 255 through the bus line 259. In the HDD 258, operation programs, various display frames, and various files such as a PLU file as a merchandise data file, a department file, an image file, a voice file, and a sales file are saved. When the settlement terminal 201 starts up, all or part of the operation programs, the various display frames, the various files, and the like are copied onto the RAM 254 so as to be used.

In the PLU file, a unit price, weight of a merchandise item, an upper limit and a lower limit for the weight, a merchandise display, a distinction between discount and non-discount, a discount price, and the like which are related to merchandise codes which respectively identify merchandise items are stored so as to be freely rewritable. The merchandise display includes text data of an item name of a merchandise item identified by a merchandise code and image data of the merchandise item.

In the department file, a unit price, weight of a merchandise item, an upper limit and a lower limit for the weight, a merchandise display, a distinction between discount and non-discount, a discount price, and the like which are related to each merchandise items which are not stored in the PLU file are stored so as to be freely rewritable. The merchandise display includes text data of an item name of a merchandise item and image data of the merchandise item.

The barcode scanner 203, the handheld barcode scanner 203*a*, the LCD 210, the touch panel 211, the card reader/writer 252, the receipt printer 251, the speaker 271, the light emitting unit 218, the cash recycling machine 221, the sensor 103, the weighing apparatus 301, and the communication interface 261 for realizing data communication with a store controller (not shown) or an attendant terminal (not shown) are connected to the controller 253 through the bus line 259. The controller 253 controls the components and executes various types of processing.

In search processing, when a barcode is scanned by the barcode scanner 203, a merchandise code which is identified by the scanned barcode is recognized, the PLU file is searched, and the unit price, the weight, and the merchandise display which are related to the recognized merchandise code are acquired.

Weight check processing judges whether a weight weighed by the weighing apparatus 301 after scanning and a weight acquired in the search processing are same or not, by judging whether or not the weighed weight is in between the upper limit and the lower limit of the weight acquired.

Merchandise sales data processing is a processing to calculate a settlement price on the basis of a unit price acquired in the search processing and to execute a settlement in the settlement unit. When the touch panel 211 is touched to execute a closing operation, a settlement price is calculated in accordance with a total amount of a sales calculation including one or more essential calculations such as a consumer tax calculation. Then, the settlement price will be registered in the RAM 254 temporarily and will be registered in the sales file. In settlement processing, a settlement of the calculated settlement price in using cash or a magnetic card like a credit card is possible. The cash recycling machine 221 enables cash handling. The card reader/writer 252 enables handling of magnetic cards. In the present embodiment, a concept of the merchandise sales data processing is used as a broad concept including the search processing, the weight check processing, and the like.

In the structure described above, the self-checkout terminal 101 enables a self-checkout. In a self-checkout, the controller 253 aids self-checkout processing by executing processing such as various arithmetic processing and control processing for driving each unit. The settlement terminal 201 shows various user aiding screens on the LCD 210 and executes various types of processing.

A flow of a processing at the start of a self-checkout will be explained with reference to various types of image examples and flowcharts on the basis of FIGS. 4 to 6.

Figure 4:
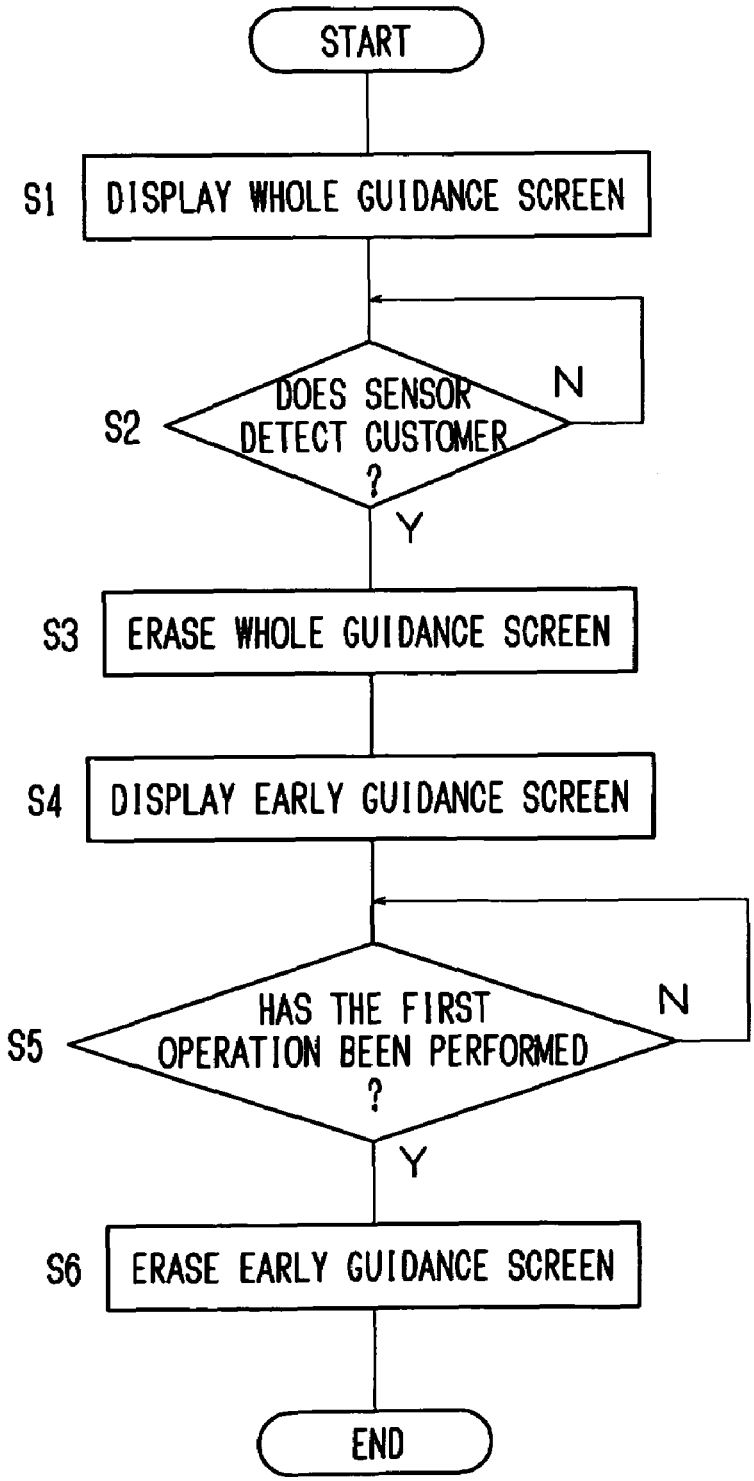
FIG. 4 is a flowchart describing a flow of a processing at the start of a self-checkout.

FIG. 4 is a flowchart describing a flow of a processing at the start of a self-checkout. The controller 253 displays a whole guidance screen G on the LCD 210 unless the sensor 103 detects that a customer is in the detection area S (step S1).

Figure 5:
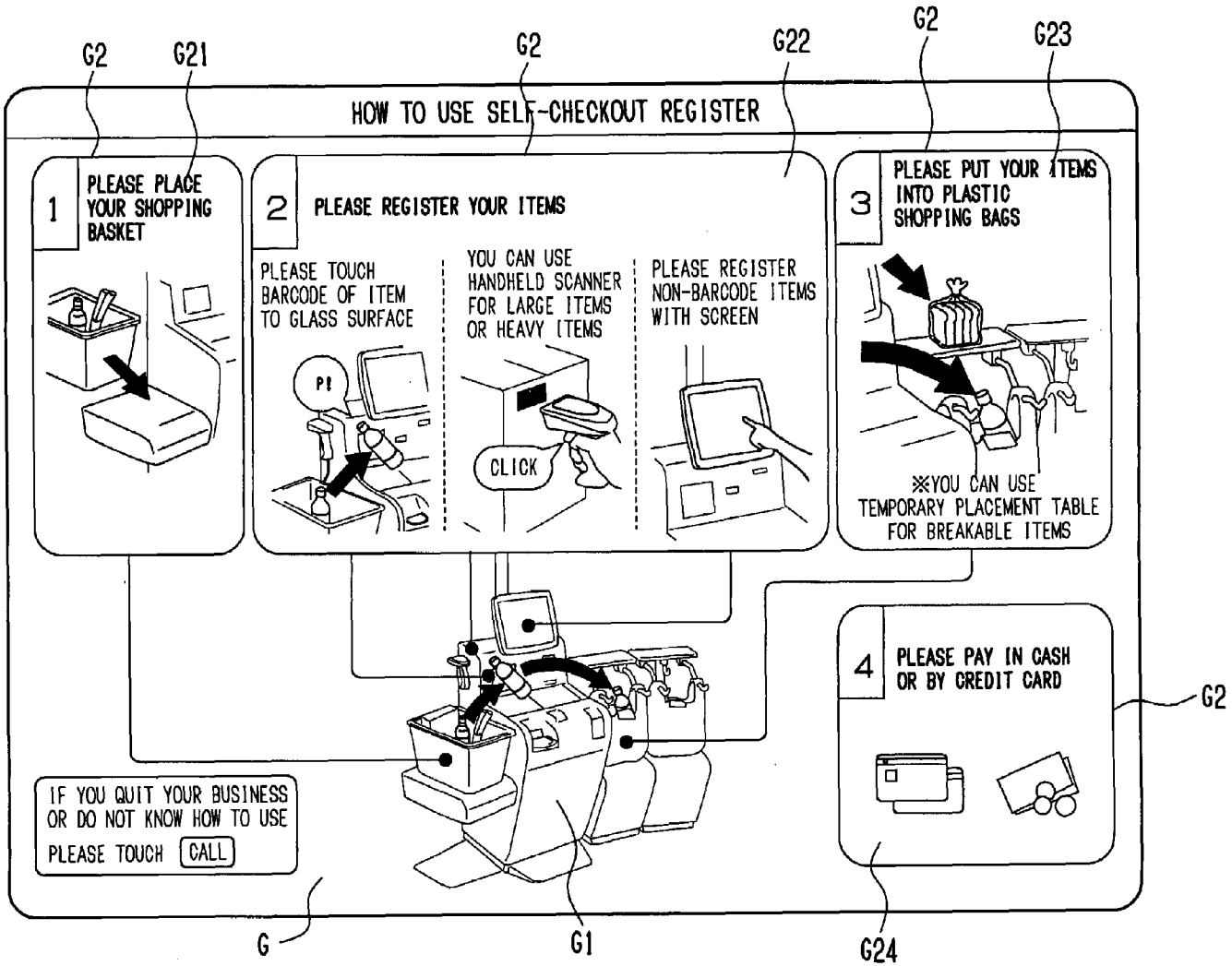
FIG. 5 is a schematic diagram showing an example of a whole guidance screen.

FIG. 5 is a schematic diagram showing an example of the whole guidance screen G. The whole guidance screen G includes a procedure summary of a self-checkout including the use of each unit of the self-checkout terminal 101 from start to finish. As shown in FIG. 5, the whole guidance screen G includes an illustration G1 showing an outside view of the self-checkout terminal 101 and guidance areas G2 showing some guidance for each stage of a self-checkout. Each of the guidance areas G2 includes a number display identifying a self-checkout stage, some operation guidance of each unit of the self-checkout terminal 101 at the stage, and an illustration aiding the operation. Hereby, a customer gets to know a self-checkout flow of the self-checkout terminal 101 from start to finish before the self-checkout.

To be more precise, the whole guidance screen G includes, as the guidance areas G2, a guidance area G21 at an upper left edge position, a guidance area G22 next to the guidance area G21, a guidance area G23 next to the guidance area G22, and a guidance area G24 below the guidance area G23. The guidance area G21 includes a number "1", the instruction "PLEASE PLACE YOUR SHOPPING BASKET", and an illustration aiding the operation of placing the shopping basket. The guidance area G22 includes a number "2", the instruction "PLEASE REGISTER YOUR ITEMS", and illustrations aiding the operation of registering the items. The guidance area G23 includes a number "3", the instruction "PLEASE PUT YOUR ITEMS INTO PLASTIC SHOPPING BAGS", and illustrations aiding the operation of putting the items in the plastic shopping bags. The guidance area G24 includes a number "4", the instruction "PLEASE PAY IN CASH OR BY CREDIT CARD", and illustrations of cash and credit cards. The guidance area G21, the guidance area G22, and the guidance area G23 are connected to the corresponding part of the illustration G1 by connecters illustrated on the screen. By viewing the number in the guidance areas G2, a customer gets to know a procedure for a self-checkout clearly. In addition, by viewing the connecters connecting the guidance areas G2 with the illustration G1, a customer gets to know what to operate at each stage of a self-checkout clearly.

In a state that the whole guidance screen G is displayed, the controller 253 outputs voice information stored in the voice file through the speaker 271. The voice information is preferably voice information reading aloud the instructions displayed on the guidance areas G2. For example, voice information "FIRST, PLEASE PLACE YOUR SHOPPING BASKET" or voice information "SECOND, PLEASE REGISTER YOUR ITEMS" is preferred.

Returning to the flowchart in FIG. 4, when the sensor 103 detects a customer (Y at step S2), the controller 253 erases the whole guidance screen G (step S3), generates a basic screen B, displays the basic screen B on the LCD 210, and displays an early guidance screen A on the basic screen B (step S4).

Figure 6:
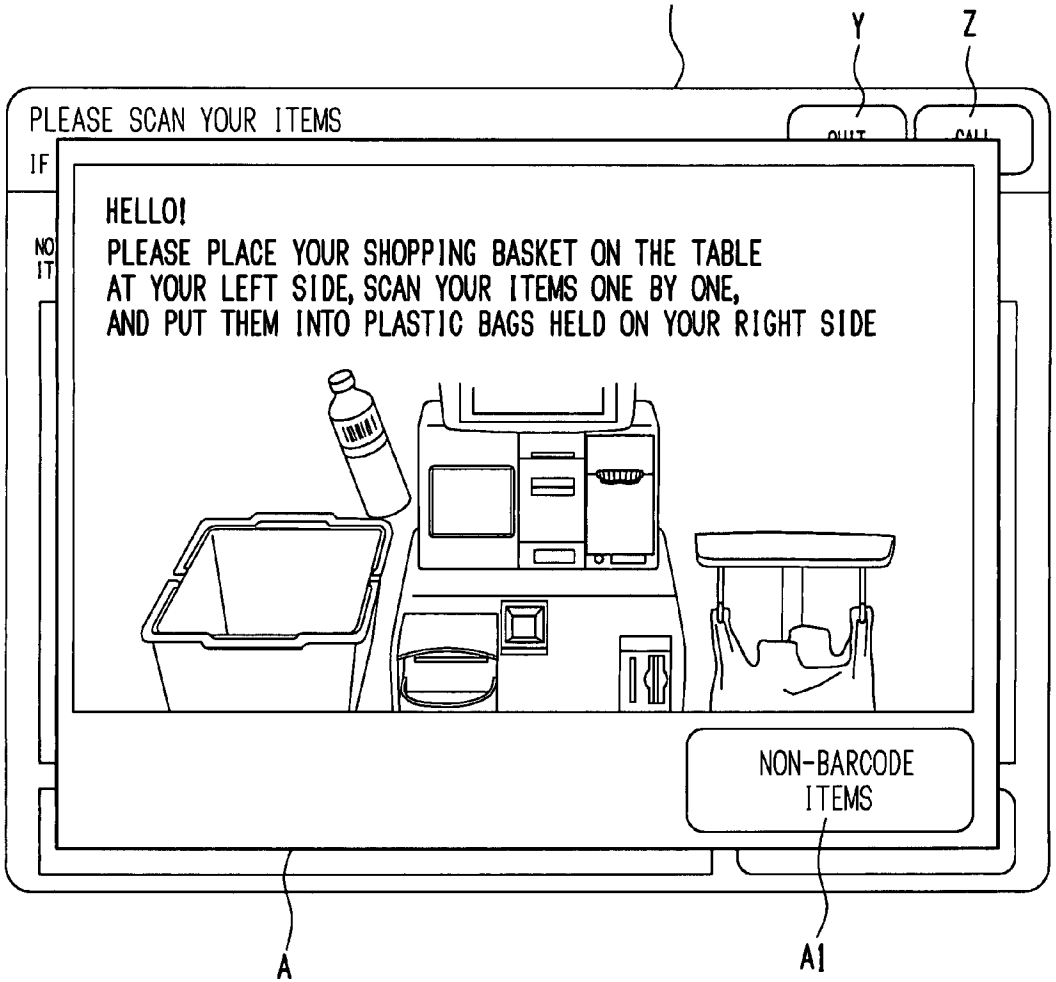
FIG. 6 is a schematic diagram showing an example of an early guidance screen displayed on a basic screen.

FIG. 6 is a schematic diagram showing an example of the early guidance screen A which is displayed on the basic screen B. The basic screen B will be described later. The early guidance screen A gives some guidance on necessary operations for starting a self-checkout. To be more precise, the instructions "PLEASE PLACE YOUR SHOPPING BASKET ON THE TABLE AT YOUR LEFT SIDE, SCAN YOUR ITEMS ONE BY ONE, AND PUT THEM INTO PLASTIC BAGS HELD ON YOUR RIGHT SIDE" is displayed together with illustrations aiding performing the instructed operations. At this time, the controller 253 outputs voice information to read aloud the instructions stored in the voice file through the speaker 271. Hereby, a customer is informed that the first operation for the self-checkout is making the barcode scanner 203 scan a merchandise code attached to an item selected by the customer. In addition, the early guidance screen A includes a button A1 with the label "NON-BARCODE ITEMS". Hereby, a customer who brings only non-barcode items to the self-checkout terminal 101 is informed that the first operation is touching the button A1.

When the sensor 103 does not detect a customer because the customer has left the self-checkout terminal 101 in a state that the early guidance screen A is displayed on the LCD 210, the controller 253 displays the whole guidance screen G on the LCD 210 again. Incidentally, when a customer having no intention to buy still approaches the self-checkout terminal 101, the whole guidance screen G is erased and the early guidance screen A is displayed. However, the whole guidance screen G is displayed again when the customer leaves the self-checkout terminal 101. Thus, showing a self-checkout flow to another customer is possible.

Returning to the flowchart in FIG. 4, when the first operation, of scanning a barcode or touching the button A1, is performed according to guidance of the early guidance screen A (Y at step S5), the controller 253 erases the early guidance screen A (step S6). When any barcode is scanned, the controller 253 generates a scan confirmation screen C which will be described below and displays it on the basic screen B after erasing the early guidance screen A. When the button A1 is touched, the controller 253 erases the early guidance screen A and displays the basic screen B.

The merchandise sales data processing executed by the controller 253 after executing the processing at the start of the self-checkout will be explained with reference to FIGS. 7 to 10. Voice information which reads aloud instructions which are displayed on each screen example will be outputted through the speaker 271. A description of the voice information will be omitted.

Figure 7:
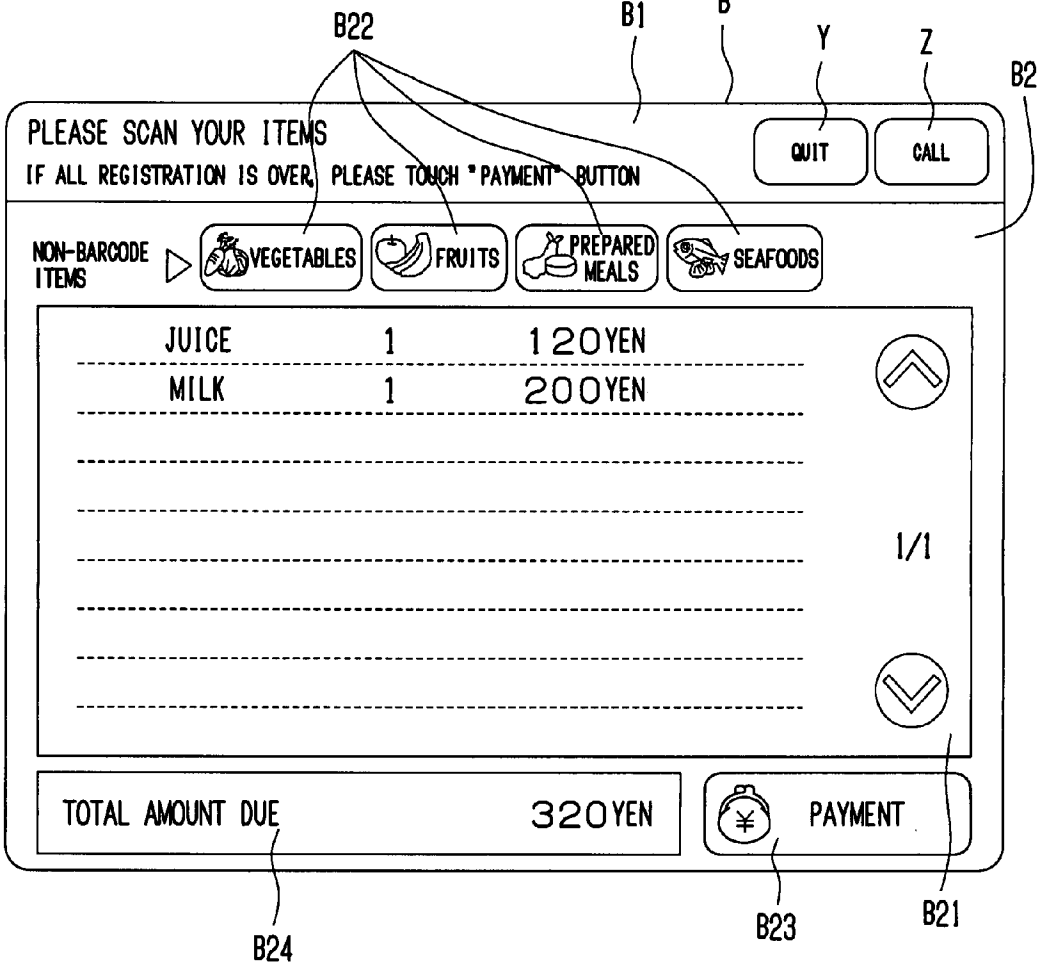
FIG. 7 is a schematic diagram showing an example of the basic screen.

FIG. 7 is a schematic diagram showing an example of the basic screen B. The basic screen B shows various types of guidance on performing a self-checkout according to each stage of the self-checkout. The basic screen B includes a guidance display area B1 disposed in an upper part of the basic screen B and a user area B2 disposed below the guidance display area B1. The guidance display area B1 includes various types of text and various types of operation buttons as guidance. The user area B2 includes a transaction detail B21 to be a purchase list for a customer, item choice buttons B22, a payment button B23, and a total amount due B24 as guidance.

The guidance display area B1 of the image example in FIG. 7 includes the instruction "PLEASE SCAN YOUR ITEMS", and the instruction "IF ALL REGISTRATION IS OVER, PLEASE TOUCH "PAYMENT"BUTTON" below "PLEASE SCAN YOUR ITEMS". In addition, the guidance display area B1 includes a quit button Y to quit a processing and an attendant call button Z to call a guide attendant as operation buttons. According to a flow of a self-checkout processing, the controller 253 displays the text and the operation buttons as guidance which can be changed.

The user area B2 includes item choice buttons B22 for a customer to choose non-barcode items, the text "NON-BARCODE ITEMS", and some information as the transaction detail B21 including names, quantities, and unit prices of items to be purchased. If the number of items is too large to be fully displayed in the transaction detail B21, scrolling will be possible by touching scroll buttons which are displayed in the transaction detail B21. In addition, the user area B2 includes the total amount due B24 at each time and the payment button B23 to be touched for executing a settlement when all registration is over. Touching the payment button B23 causes closing of the self-checkout.

When a customer places a merchandise item in a front of the barcode scanner 203 for scanning in accordance with guidance displays which are displayed in the guidance display area B1, the controller 253 executes the search processing described above and acquires some necessary information from the PLU file. At this time, the controller 253 generates the scan confirmation screen C as guidance and displays the scan confirmation screen C on the user area B2.

Figure 8:
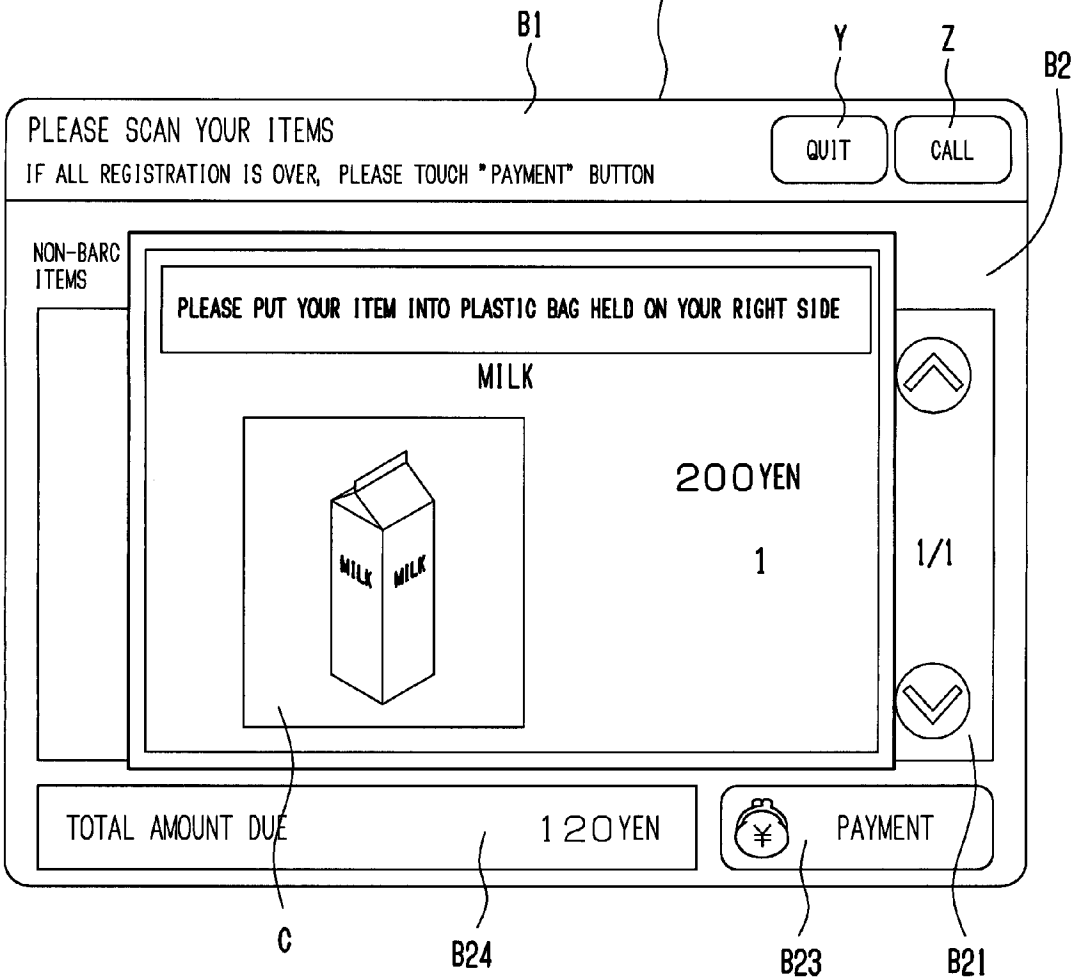
FIG. 8 is a schematic diagram showing an example of a scan confirmation screen displayed on a user area of the basic screen.

FIG. 8 is a schematic diagram showing an example of the scan confirmation screen C displayed on the user area B2 of the basic screen B. The scan confirmation screen C includes a transaction detail of an item whose barcode is scanned. The transaction detail includes a unit price acquired from the PLU file and a quantity of an item to be bought. In addition, the scan confirmation screen C includes text based on a text data of the item name and an illustration based on an image data of the item which are based on a merchandise display stored in the PLU file. In an upper part of the scan confirmation screen C, the instruction "PLEASE PUT YOUR ITEMS INTO PLASTIC BAGS HELD ON YOUR RIGHT SIDE" is displayed as guidance. Hereby, a customer is informed of the next operation to perform.

When a customer puts items whose barcodes have been scanned into a plastic bag, the items in the plastic bag apply their loads to the weighing plate 303 of the weighing apparatus 301. The loads are weighed by the loadcell unit. A weighing result of the loadcell unit is sent to the settlement terminal 201. The settlement terminal 201 receives the weighing result and executes the weight check processing. When the weight weighted by the loadcell is judged not to be the same as the weights of the scanned merchandise items that are stored in the PLU file as a result of the weight check processing, the controller 253 stops executing the merchandise sales data processing and changes an emission color of the light emitting unit 218 to red from blue in order to let shop attendants know that an operation error or an irregularity has occurred. At this time, because what is displayed on the LCD 210 is still the scan confirmation screen C, a customer knows that executing of the processing has stopped. On the other hand, when the weight weighed by the loadcell is judged to be the same as the weights of the scanned merchandise items that are stored in the PLU file, the controller 253 permits execution of the merchandise sales data processing and erases the scan confirmation screen C.

In the user area B2 shown in FIG. 7, item choice buttons B22, which are shown as being four kinds of touch buttons, namely "VEGETABLES", "FRUITS", "PREPARED MEALS", and "SEAFOODS", are displayed as images to register non-barcode items. If a customer wants to buy a non-barcode item, the customer has to touch the item choice buttons B22 through the touch panel 211. In addition, if a customer touches the button A1 of the early guidance screen A at step S5 of the flowchart shown in FIG. 4, the early guidance screen A will be erased and the customer has to touch the item choice buttons B22 according to guidance displayed on the user area B2. When any of the item choice buttons B22 are touched, the transaction detail B21 displayed on the user area B2 changes into a department choice screen E as guidance.

Figure 9:
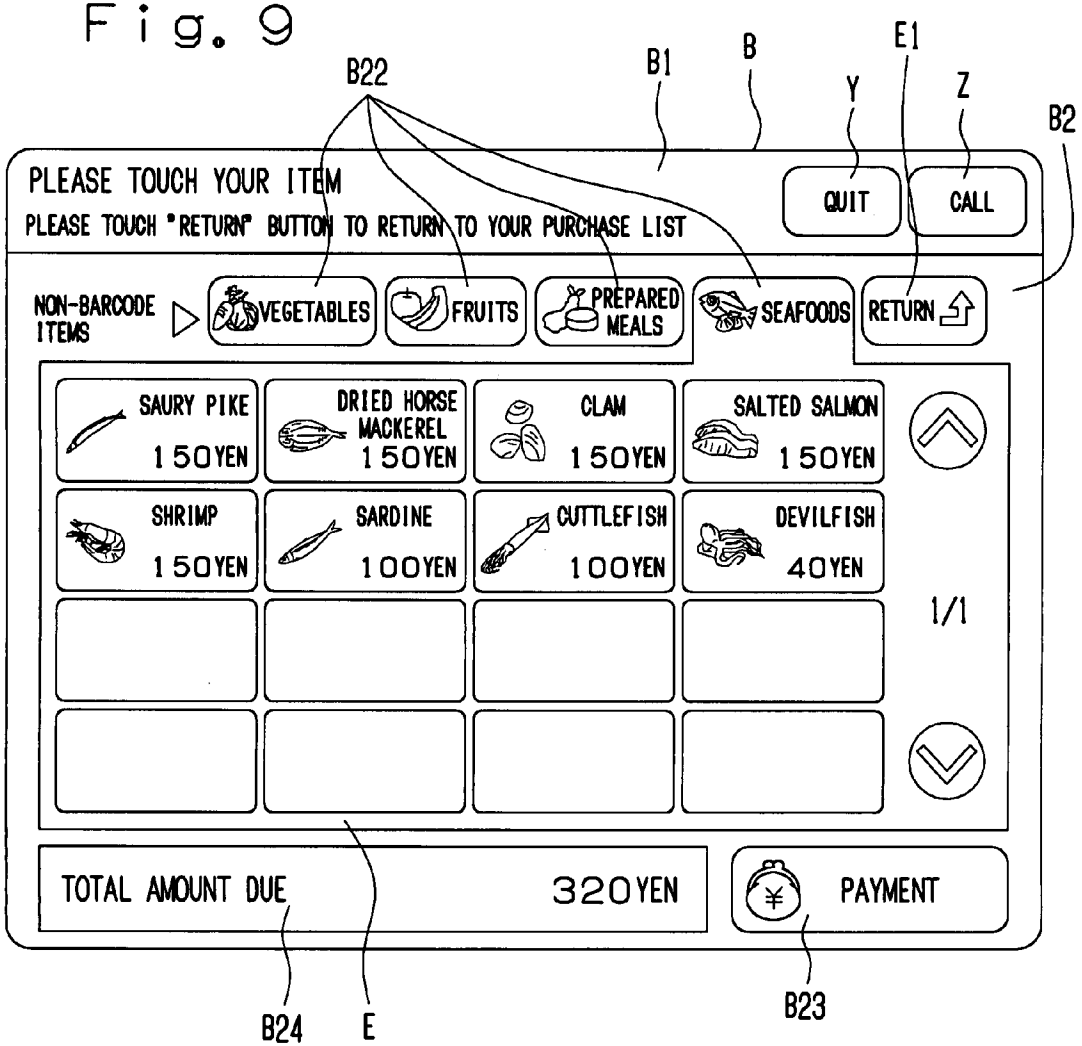
FIG. 9 is a schematic diagram showing an example of the basic screen in a state that a department choice screen is displayed in the user area.

FIG. 9 is a schematic diagram showing an example of the basic screen B in a state that the department choice screen E is displayed in the user area B2. The image example in FIG. 9 shows a state that "SEAFOODS" is touched. In this state, the department choice screen E scrollably shows 16 kinds (four rows and four columns) of various foods in a "SEAFOODS" category. A return button E1 is displayed in the department choice screen E, also. When the return button E1 is touched through the touch panel 211, the department choice screen E changes into the transaction detail B21. While the department choice screen E is displayed in the user area B2, the controller 253 displays the instruction "PLEASE TOUCH YOUR ITEM" as guidance in guidance display area B1. Hereby, a customer is informed of the next operation. When a customer touches a food item in the department choice screen E through the touch panel 211 in accordance with the guidance, the department registration screen F as guidance on the food item appears on the user area B2 of the basic screen B.

Figure 10:
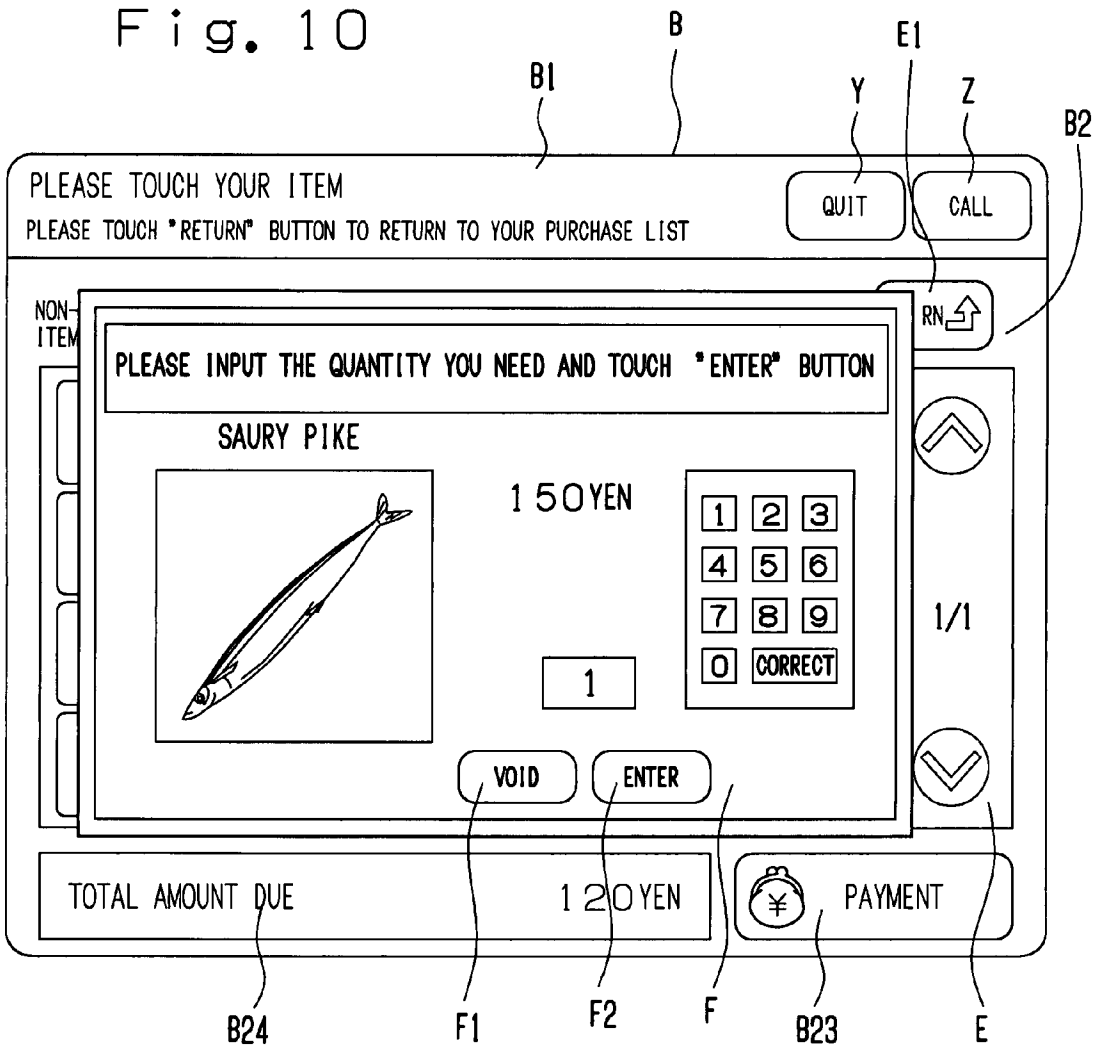
FIG. 10 is a schematic diagram showing an example of a department registration screen displayed on the user area of the basic screen.

FIG. 10 is a schematic diagram showing an example of the department registration screen F displayed on the user area B2 of the basic screen B. The department registration screen F includes a transaction detail. The transaction detail includes a unit price and a quantity of an item to be bought. In addition, the department registration screen F includes text based on a text data of a name of an item, an illustration based on an image data of the item, and a numeric keypad. The department registration screen F may include a discount price and the like. The numeric keypad enables a customer to input a quantity of an item, which is one by default, in order to change the quantity of the item to be purchased. The various types of data are based on information stored in the department file. The department registration screen F includes a button F1 "VOID" and a button F2 "ENTER". When the button F1 is touched through the touch panel 211, the basic screen B where the department choice screen E is displayed on the user area B2 returns.

In addition, the department registration screen F includes the instruction "PLEASE INPUT THE QUANTITY YOU NEED AND TOUCH "ENTER" BUTTON" as guidance. Hereby, a customer is informed of the next operation. When the button F2 is touched after inputting a quantity of an item in accordance with the guidance, a department registration of the item by the quantity is finished. Then, the controller 253 displays the scan confirmation screen C on the user area B2. The weight check processing is executed after displaying the scan confirmation screen C. That is to say, there is a similarity between the processing when the merchandise item does not have a barcode and the processing which is executed when a barcode is scanned by the barcode scanner 203. Therefore, a description of the processing which is executed after displaying the scan confirmation screen C will be omitted.

The settlement processing will be explained with reference to FIGS. 11 to 15.

Figure 11:
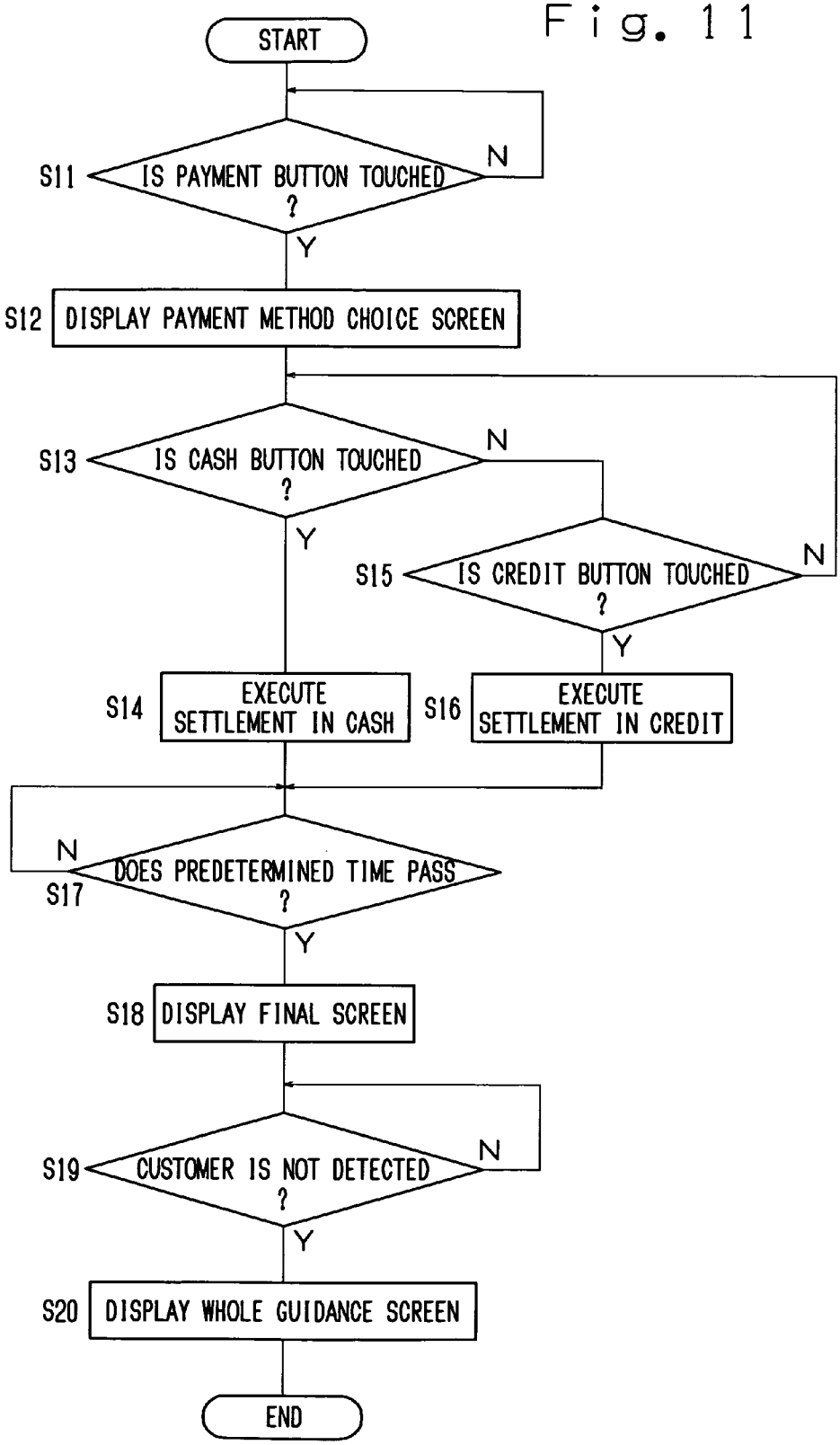
FIG. 11 is a flowchart describing a flow of a settlement processing.

FIG. 11 is a flowchart describing a flow of the settlement processing. When a customer touches the payment button B23 through the touch panel 211 according to guidance "IF ALL REGISTRATION IS OVER, PLEASE TOUCH "PAYMENT" BUTTON" which is displayed in the guidance display area B1 (Y at step S11), the controller 253 changes what is displayed in the user area B2 into a payment method choice screen J as guidance (step S12).

Figure 12:
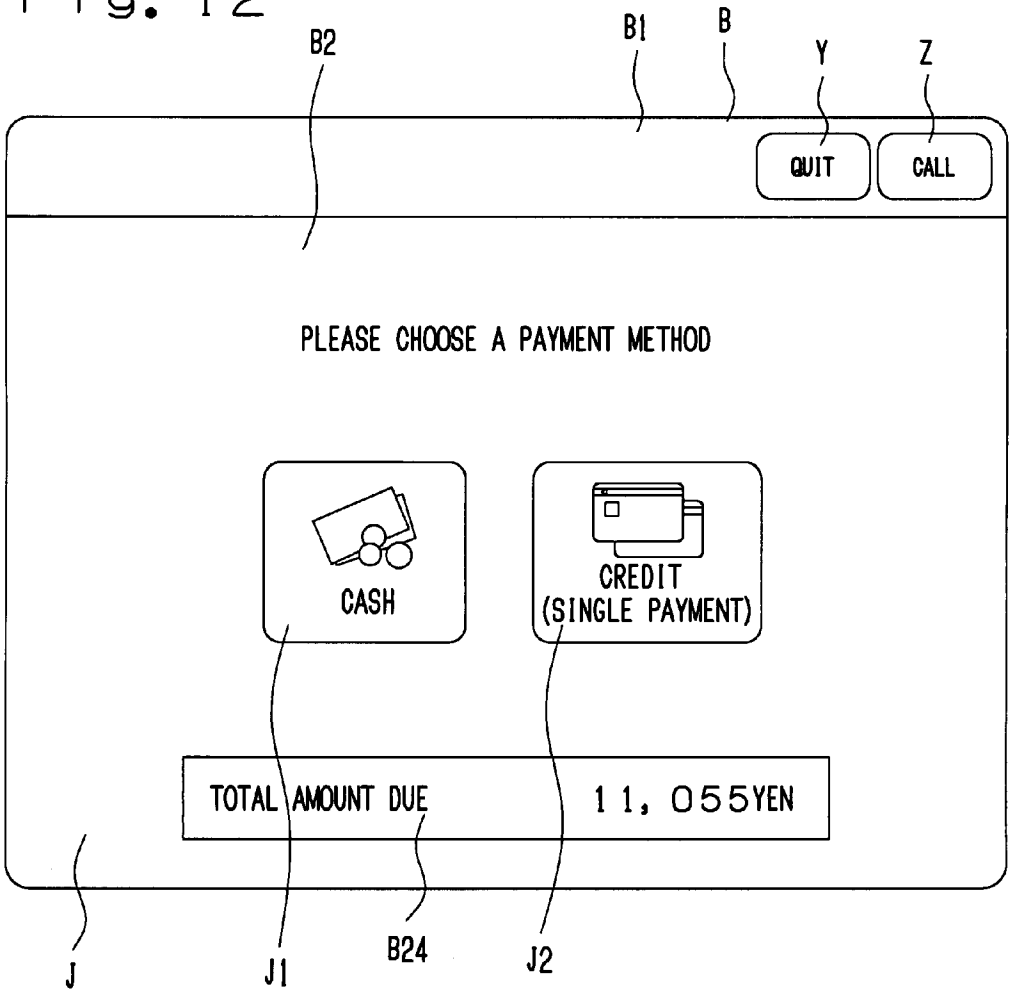
FIG. 12 is a schematic diagram showing an example of the basic screen in a state that a payment method choice screen is displayed on the user area.

FIG. 12 is a schematic diagram showing an example of the basic screen B in a state that the payment method choice screen J is displayed on the user area B2. The payment method choice screen J includes, as guidance, the instruction "PLEASE CHOOSE A PAYMENT METHOD", total amount due B24, a button J1 and a button J2. The button J1 is touched to choose a settlement in cash. The button J2 is touched to choose a settlement in credit.

Returning to the flowchart in FIG. 11, when the button J1 is touched (Y at step S13), the controller 253 executes a settlement in cash (step S14). First, the controller 253 changes what is displayed in the user area B2 into a cash settlement guidance screen (not shown) which gives guidance on the inserting of money into the cash recycling machine 221 to a customer. For example, if any money is not inserted into the cash recycling machine 221, the cash settlement guidance screen shows guidance such as the instruction "PLEASE INSERT MONEY" and an illustration showing an operation of inserting money. When money is inserted, guidance "WHEN MAKING A PAYMENT, PLEASE TOUCH A "CONFIRM" BUTTON" is displayed and an amount inserted confirmation button appears. When the amount inserted confirmation button is touched, the controller 253 changes what is displayed in the in the user area B2 into a cash settlement confirmation screen (not shown). The cash settlement confirmation screen includes a button "YES" and a button "NO". When the button "NO" is touched, the controller 253 changes what is displayed in the in the user area B2 into the cash settlement guidance screen displayed last. When the button "YES" is touched, the controller 253 changes what is displayed in the in the user area B2 into a cash settlement finish screen M as guidance.

Figure 13:
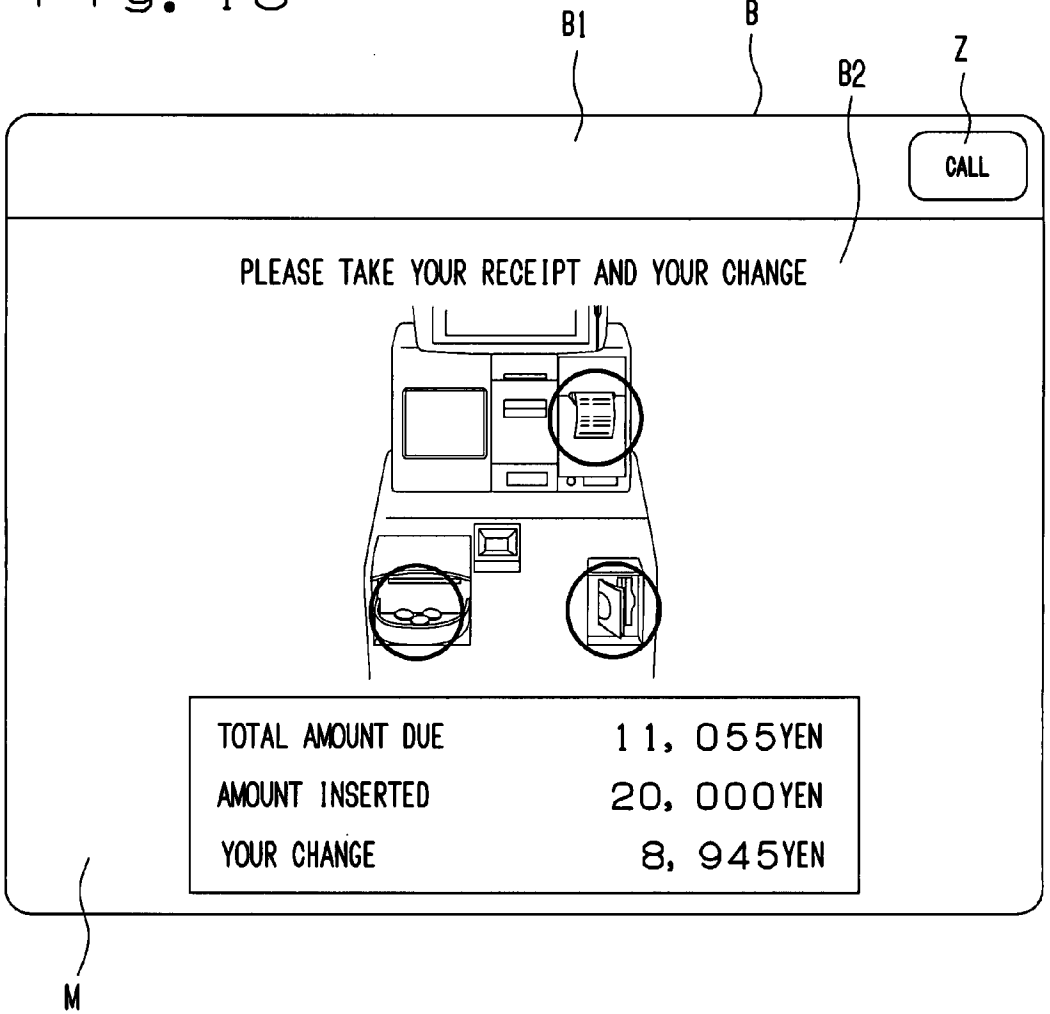
FIG. 13 is a schematic diagram showing an example of the basic screen in a state that a cash settlement finish screen is displayed on the user area.

FIG. 13 is a schematic diagram showing an example of the basic screen B in a state that the cash settlement finish screen M is displayed on the user area B2. The cash settlement finish screen M includes guidance including the instruction "PLEASE TAKE YOUR RECEIPT AND YOUR CHANGE" and an illustration showing the operation of taking the receipt and change to a customer.

Returning to the flowchart in FIG. 11, when the button J2 is touched (Y at step S15), the controller 253 executes a settlement in credit (step S16). First, the controller 253 changes what is displayed in the user area B2 into a credit settlement guidance screen K as guidance.

Figure 14:
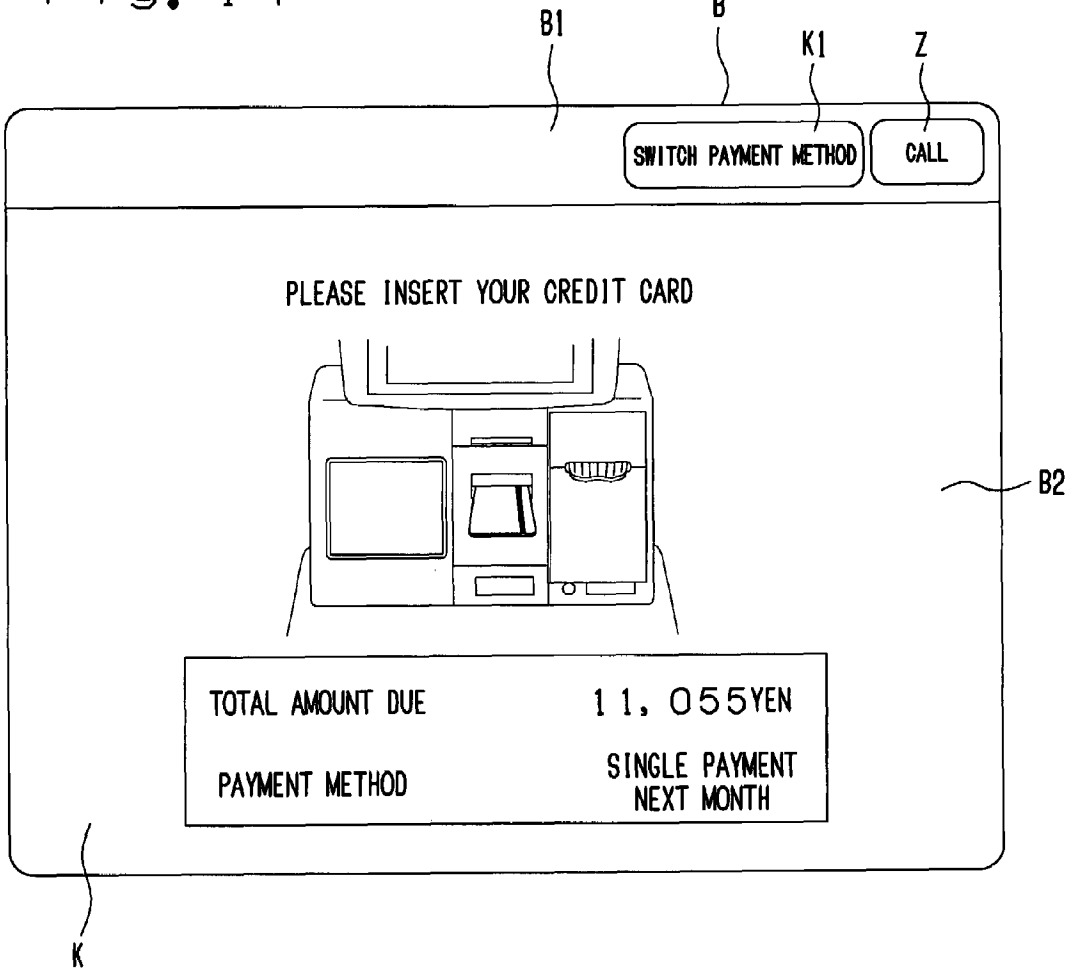
FIG. 14 is a schematic diagram showing an example of the basic screen in a state that a credit settlement guidance screen is displayed on the user area.

FIG. 14 is a schematic diagram showing an example of the basic screen B in a state that the credit settlement guidance screen K is displayed on the user area B2. The credit settlement guidance screen K includes the instruction "PLEASE INSERT YOUR CREDIT CARD" and an illustration aiding the operation of inserting a credit card as guidance. At this time, a payment method switching button K1 is displayed in the guidance display area B1. When the payment method switching button K1 is touched, the controller 253 returns what is displayed in the user area B2 into the payment method choice screen J.

A customer inserts a credit card into the card insertion slot 212 according to the guidance. When the card reader/writer 252 reads information on a magnetic stripe of the credit card, the controller 253 changes what is displayed in the user area B2 into a credit settlement confirmation screen (not shown). If the card reader/writer 252 cannot read information on a magnetic stripe precisely, some guidance prompting the customer to perform the operation for a second reading will be displayed. The credit settlement confirmation screen includes a button "YES" and a button "NO". When the button "NO" is touched, the controller 253 changes what is displayed in the user area B2 into the credit settlement guidance screen K displayed last. When the button "YES" is touched, a verification screen (not shown) including the text "CARD VERIFYING IS IN PROGRESS" is displayed and a verification processing is executed. When the card verification is not successful, the controller 253 changes what is displayed in the user area B2 into a verification refusal screen (not shown). On the other hand, when the card verification is successful, the controller 253 changes what is displayed in the user area B2 into a credit settlement finish screen (not shown) including the instruction "PLEASE TAKE YOUR RECEIPT" and an illustration showing the operation of taking the receipt.

Returning to the flowchart in FIG. 11, when a predetermined time passes after a settlement in cash or credit (Y at step S17), the controller 253 erases the basic screen B and displays a final screen N (step S18).

Figure 15:
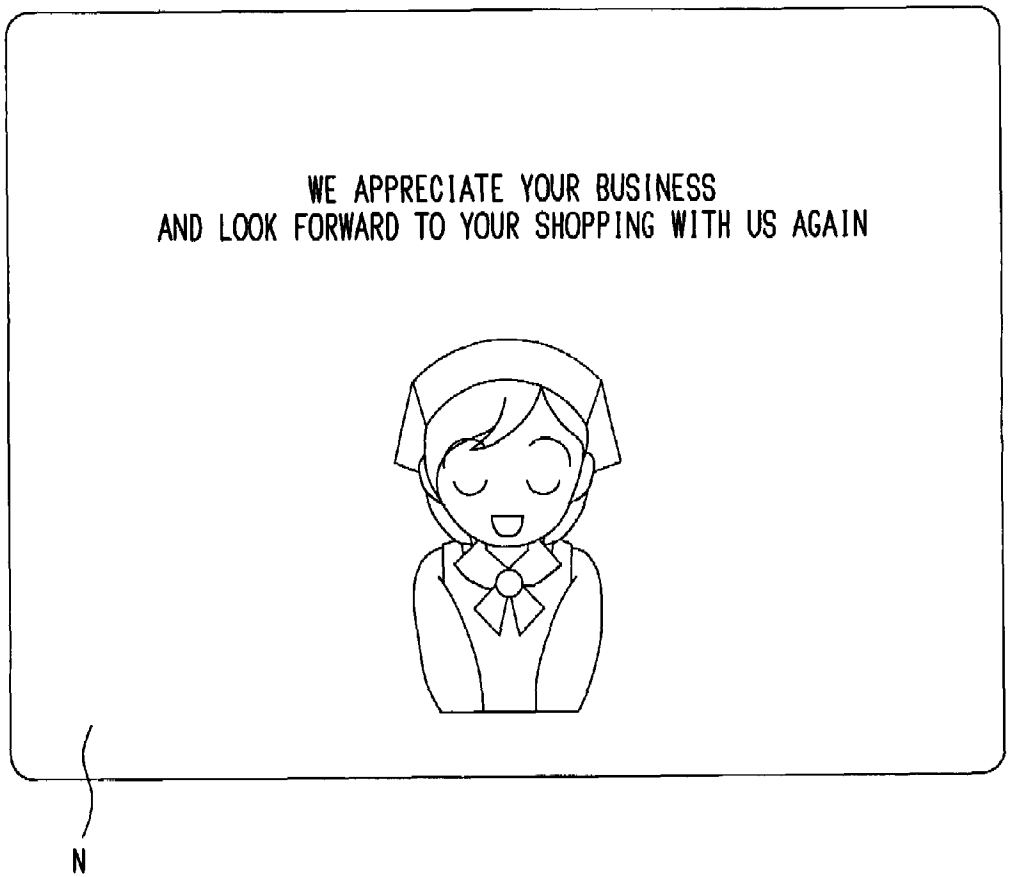
FIG. 15 is a schematic diagram showing an example of a final screen.

FIG. 15 is a schematic diagram showing an example of the final screen N. The final screen N includes the text "WE APPRECIATE YOUR BUSINESS AND LOOK FORWARD TO YOUR SHOPPING WITH US AGAIN" and an illustration of a shop attendant.

Returning to the flowchart in FIG. 11, when the final screen N is displayed (step S18) and the sensor 103 does not detect a customer, since the customer has left the self-checkout terminal 101 because the customer's self-checkout is over (Y at step S19), the controller 253 erases the final screen N and displays the whole guidance screen G on the LCD 210 again (step S20). That is, when the sensor 103 does not detect a customer after execution of the merchandise sales data processing is over, the whole guidance screen G is displayed on the LCD 210. Hereby, it will be possible to show a flow of the self-checkout to other customers who have not yet performed the self-checkout. When the sensor 103 does not detect a customer, each unit provided to the settlement terminal 201 may enter a sleep mode.

Obviously, numerous modifications and variations of the present invention are possible in light of the above description of the present invention. It is therefore to be understood that within the scope of the appended claims, the invention may be practiced otherwise than as specifically described herein.

What is claimed is:

1. A self-checkout terminal, comprising:

a settlement terminal which: (i) comprises units for self-checkout including a basket placement unit for placing a shopping basket, a scanning unit for scanning merchandise codes, an input unit for inputting information, and a settlement unit for transacting settlement, each of said units being positioned so as to be operable by a customer, and (ii) executes merchandise sales data processing based on at least one of the merchandise codes scanned by the scanning unit and the information input via the input unit;

a display provided to the settlement terminal for displaying information;

a sensor which detects whether or not a customer is in a position where operation of the units of the settlement terminal by the customer is possible; and a controller which (i) when the sensor does not detect a customer, displays on the display a whole guidance screen comprising a procedure summary of the self-checkout, including use of the units of the settlement terminal, from start to finish of the self-checkout, (ii) when the sensor detects a customer, erases the whole guidance screen on the display and displays on the display a basic screen showing guidance for performing the self-checkout, and (iii) changes the guidance displayed on the basic screen in accordance with a stage of the self-checkout.

2. The self-checkout terminal according to claim 1, wherein the controller displays the whole guidance screen on the display when the sensor does not detect a customer after the merchandise sales data processing is executed.

3. The self-checkout terminal according to claim 2, wherein the controller displays an early guidance screen comprising guidance for performing a first operation for starting the self-checkout on the basic screen when the sensor detects a customer, and the controller erases the early guidance screen when the first operation has been performed.

4. The self-checkout terminal according to claim 3, wherein the controller displays the whole guidance screen on the display when the sensor does not detect a customer while the early guidance screen is displayed on the display.

5. The self-checkout terminal according to claim 1, wherein the procedure summary of the whole guidance screen comprises a plurality of guidance areas each displaying guidance for a respective stage of the self-checkout.

6. The self-checkout terminal according to claim 5, wherein the whole guidance screen comprises an illustration of an external view of the self-checkout terminal, and at least one of the guidance areas is displayed so as to be associated in the whole guidance screen with a corresponding part of the illustration of the external view of the self-checkout terminal.

7. The self-checkout terminal according to claim 5, wherein the whole guidance screen comprises an illustration of an external view of the self-checkout terminal, and at least one of the guidance areas in the whole guidance screen is displayed so as to be connected by an illustrated connection with a corresponding part of the illustration of the external view of the self-checkout terminal.

8. The self-checkout terminal according to claim 5, wherein the guidance areas in the whole guidance screen are numbered to indicate an order of the respective stages of the self-checkout corresponding to the guidance areas.

9. The self-checkout terminal according to claim 5, wherein each of the guidance areas in the whole guidance screen comprises text guidance and an illustration associated with the text guidance.

* * * * *